US005588019A

United States Patent [19]

Ruffini et al.

[11] Patent Number: 5,588,019

[45] **Date of Patent: *Dec. 24, 1996**

[54] HIGH PERFORMANCE INDUCTION MELTING COIL

[75] Inventors: Robert S. Ruffini, Birmingham; Robert J. Madeira, Sterling Heights; Robert T. Ruffini, Southfield, all of Mich.

[73] Assignee: Fluxtrol Manufacturing, Inc., Troy, Mich.

[ * ] Notice: The term of this patent shall not extend beyond the expiration date of Pat. No. 5,418,811.

[21] Appl. No.: 389,013

[22] Filed: Feb. 15, 1995

Related U.S. Application Data

[63] Continuation of Ser. No. 866,051, Apr. 8, 1992, Pat. No. 5,418,811.

[51] Int. Cl.[6] ..... H05B 5/16

[52] U.S. Cl. ..... 373/152; 373/153; 373/155

[58] Field of Search ..... 373/152, 153, 373/155, 151, 154, 156; 219/630, 672, 676, 677

[56] References Cited

U.S. PATENT DOCUMENTS

| | | | |
|---|---|---|---|
| 1,830,481 | 11/1931 | Northrup | 373/153 |
| 2,105,070 | 6/1936 | Bandar . | |
| 2,238,382 | 4/1941 | Beegehold . | |
| 2,553,690 | 5/1951 | Walsh . | |
| 2,873,344 | 2/1959 | Kocks et al. . | |
| 2,977,263 | 3/1961 | Harendza-Harinxma . | |
| 2,998,840 | 9/1961 | Davis . | |
| 3,004,091 | 10/1961 | Tama et al. | 373/152 |
| 3,014,825 | 12/1961 | Harendza-Harinxma . | |
| 3,017,485 | 1/1962 | Hansen . | |
| 3,167,454 | 1/1965 | Tompson . | |
| 3,231,648 | 1/1966 | Eyre et al. . | |
| 3,304,164 | 2/1967 | Charpentier et al. . | |
| 3,311,695 | 3/1967 | Kasper | 373/152 |
| 3,414,660 | 12/1968 | Beckius | 373/152 |
| 3,651,299 | 3/1972 | O'Neill . | |
| 3,666,571 | 5/1972 | Laing . | |
| 3,704,336 | 11/1972 | Synnestvedt | 373/152 |
| 3,785,046 | 1/1974 | Jennings . | |
| 3,798,059 | 3/1974 | Astle et al. . | |
| 3,808,074 | 4/1974 | Smith et al. . | |
| 3,846,609 | 11/1974 | Enk . | |
| 3,848,331 | 11/1974 | Pavlik et al. . | |
| 3,863,764 | 2/1975 | Myslinski et al. . | |
| 3,892,908 | 7/1975 | Lovness . | |
| 3,900,695 | 8/1975 | Andersson et al. | 373/150 |
| 3,992,690 | 11/1976 | Sperr, Jr. . | |
| 4,060,784 | 11/1977 | Fergestad . | |
| 4,158,581 | 6/1979 | Krause et al. . | |
| 4,177,089 | 12/1979 | Bankson . | |
| 4,216,017 | 8/1980 | Carcey . | |
| 4,236,139 | 11/1980 | Haglund . | |
| 4,260,582 | 4/1981 | Kumar et al. . | |
| 4,271,114 | 6/1981 | Ohno . | |
| 4,282,174 | 8/1981 | Chase et al. . | |

(List continued on next page.)

FOREIGN PATENT DOCUMENTS

| | | |
|---|---|---|
| 0205786A1 | 12/1986 | European Pat. Off. . |
| 272166 | 6/1927 | United Kingdom . |
| 645465 | 11/1950 | United Kingdom . |
| 704389 | 2/1954 | United Kingdom . |
| 916646 | 1/1963 | United Kingdom . |
| 932602 | 7/1963 | United Kingdom . |

OTHER PUBLICATIONS

"Carbonyl from Powders" GAF Corporation, 28 pages.

*Primary Examiner*—Tu Hoang
*Attorney, Agent, or Firm*—Harness, Dickey & Pierce, P.L.C.

[57] ABSTRACT

An improved induction melting coil apparatus encapsulated with homogeneous inserts for controlling the direction of inductor flux density is disclosed. The inserts are relatively thick and rigid members which provide a low reluctance path within which the magnetic field travels while inhibiting inductive coupling of the magnetic field with surrounding auxiliary components. The inserts can be easily formed or machined into any desired shape for effectively encapsulating virtually any type of coreless induction melting coil.

19 Claims, 4 Drawing Sheets

U.S. PATENT DOCUMENTS 4,297,386 10/1981 Gillette .
4,320,080 3/1982 Esper et al. .
4,371,742 2/1983 Manly .
4,401,486 8/1983 Pusateri et al. .
4,438,310 3/1984 Cachat .
4,472,616 9/1984 Maurice et al. .
4,486,641 12/1984 Ruffini .
4,622,679 11/1986 Voss ..... 373/152
4,776,980 10/1988 Ruffini ..... 252/513
5,197,081 3/1993 Fishman ..... 373/152
5,418,811 5/1995 Ruffini et al. ..... 373/152

HIGH PERFORMANCE INDUCTION MELTING COIL

This is a continuation of U.S. patent application Ser. No. 07/866,051, filed Apr. 8, 1992 now U.S. Pat. No. 5,418,811.

BACKGROUND AND SUMMARY OF THE INVENTION

The present invention relates generally to inductors and, more particularly, to a high performance induction melting coil encapsulated with-blocks or inserts fabricated from a low reluctance composition useful in controlling the direction of the inductor's flux density.

Inductors or inductor coils are generally used to heat a workpiece made of a conductive material via currents induced by varying an electromagnetic field. As such, electromagnetic energy is transferred from the inductor to the workpiece. More particularly, as alternating current from a power source flows through the inductor coil, a highly concentrated magnetic field is established within the coil. The strength of the magnetic field depends primarily on the magnitude of the current flowing in the coil. Thus, the magnetic field induces an electric potential in the workpiece and, since the workpiece represents a closed circuit, the induced voltage causes the flow of current. These induced currents are commonly called eddy currents such that the current flowing in the workpiece can be considered as the summation of all of the eddy currents. Resistance of the workpiece to the flow of the induced current generates heating by $I^2R$ losses. Therefore, heat is generated in the workpiece by hysteresis and the eddy current losses, with the heat generated being a result of the energy expended in overcoming the electrical resistance of the workpiece. Typically, close spacing is used between the inductor coil and the workpiece, and high coil currents are used to obtain maximum induced eddy currents and resulting high heating rates.

Induction heating is widely employed in the metal working industry to heat metals for soldering, brazing, annealing, hardening, forging, induction melting and sintering, as well as for other various induction heating applications. As compared to other conventional processes, induction heating has several inherent advantages. First, heating is induced directly into the conductive workpiece for providing an extremely rapid method of heating. Furthermore, induction heating is not limited by the relatively slow rate of heat diffusion associated with conventional processes using surface contact or radiant heating methods. Second, because of a "skin" effect, heating is localized and the area of the workpiece to be heated is determined by the shape and size of the inductor coil. Third, induction heating is easily controllable, resulting in uniform high quality heat treatment of the product. Fourth, induction heating lends itself to automation, in-line processing, and automatic process cycle control. Fifth, start-up time is short, and thus standby losses are low or nonexistent. And sixth, working conditions are better because of the absence of noise, fumes, and radiated heat. As will be appreciated, numerous other advantages exist for selecting induction heating over conventional heating processes.

Modernly, induction melting has gained wide-spread acceptance in the metal working industry as the method of choice due to its previously-noted advantages. Traditionally, "coreless" melting coils have been fabricated by winding copper tubing around a mandrel having a predetermined shape. Thereafter, a plurality of studs are brazed to an outer peripheral surface of the copper tubing. The studs are secured by suitable fasteners to phenolic or wooden stud board for rigidly maintaining the turns of the melting coil in a predefined spacial relationship. As is known, an inherent tendency exists for the lines of magnetic flux generated by the melting coil to inductively couple with any surrounding conductive materials (such as when the melting coil is placed within a vacuum chamber) which, in turn, heats the surrounding conductive material and/or interferes with operation of surrounding control systems. It is also well known that the magnetic flux generated by the inductor must be dense enough to bring the workpiece to a desired temperature in a specified time (typically short).

In the past, it has been recognized that the performance of induction melting coils may be improved by controlling the direction of flux flow and thereby manipulating and maximizing flux density on the workpiece. Conventionally, with an induction melting coil of generally circular cross-section, directional control was thought to be improved by attaching laminated stacks of flux controlling elements or "shunts" on certain portions of the circumference, so that the magnetic flux is intensified on the corresponding area of the workpiece. Typically, such shunts include laminations made of grain-oriented iron (which are generally made from relatively thin pieces of silicon steel strip stock) and which are attached to the inductor on a strip by strip or layer by layer basis as necessary. While generally satisfactory for shielding or "blocking" the field from heating surrounding conductive components, shunts are generally unsatisfactory to the extent that they are difficult to apply, requiring cutting and sizing to the necessary configuration. Thus some portions or parts of an inductor cannot be covered because of the difficulty of application. Applying "shunt" laminations to large inductors is also somewhat prohibitive due primarily to excessive cost and labor considerations. In addition, these iron laminations have a tendency to lose permeability at high operating temperatures which results in inefficient heating operations. Furthermore, at higher temperatures, the shunts require cooling due to relatively high hysteresis and eddy current losses.

Accordingly, the present invention relates to improved inductors and, more specifically, to improved induction melting coils encapsulated with block or inserts fabricated from a composition useful in controlling the direction of inductor flux density. In this manner, the induction melting coil is encapsulated to provide a low reluctance path within which the magnetic field travels while "blocking" inductive coupling of the magnetic field with surrounding auxiliary components.

In a preferred form, the flux concentrator blocks of the present invention are made of a composition employing a high purity, annealed, electrolytically prepared iron powder with a unique physical characteristic and a polymer binder which includes a resin or mixture of resins. The compositions may optionally employ an additional material or component such as an acid phosphate insulating coating. The flux concentrator inserts or blocks fashioned from the resulting compositions provide improved performance when employed in induction melting modalities over conventional, art disclosed shunt materials in that the inserts formed from these compositions maintain the necessary permeability and demonstrates a maximum of about sixty (60) percent regression in permeability between the commonly employed frequencies of 10 KHz and 500 KHz and a total core loss of less than about 0.8 to about 1.2 ohms in this range. The iron powder in the compositions of the present invention is characterized in that it is substantially non-spherical and generally flat or dim-shaped and possesses a specific surface area of less than about 0.25 $m^2/g$. The iron powder described above is particularly well-suited for use in induction melting coils in that it permits the formation of a relatively thick and rigid flux controlling insert by pressing at relatively high pressures such that the insert possesses a very high density with an extremely high ratio of ferromagnetic material to binder material while still permitting the binder material to perform well.

Further objects and advantages of the present invention will become apparent to one skilled in the art from examination of the following written description taken in conjunction with the accompanying drawings and the appended claims.

DETAILED DESCRIPTION OF THE PRESENT INVENTION

With particular reference to the drawings, various exemplary embodiments of induction melting coils constructed in accordance with the principles of the present invention are shown. In general, the present invention is directed to improvements in induction melting coils and to their methods of manufacture. More particularly, the present invention is directed to construction of an induction melting coil encapsulated with flux controlling means for providing a low reluctance path for the magnetic field to travel within. In addition, the flux controlling means also offer the additional advantage of confining the lines of magnetic flux around the copper melting coil to inhibit coupling thereof with any surrounding conductive material, so as to inhibit inductive heating of surrounding metals. Finally, the flux controlling means is configured to substantially encapsulate the melting coil for concentrating the flux or magnetic field with respect to the workpiece to be melted.

Figure 1:
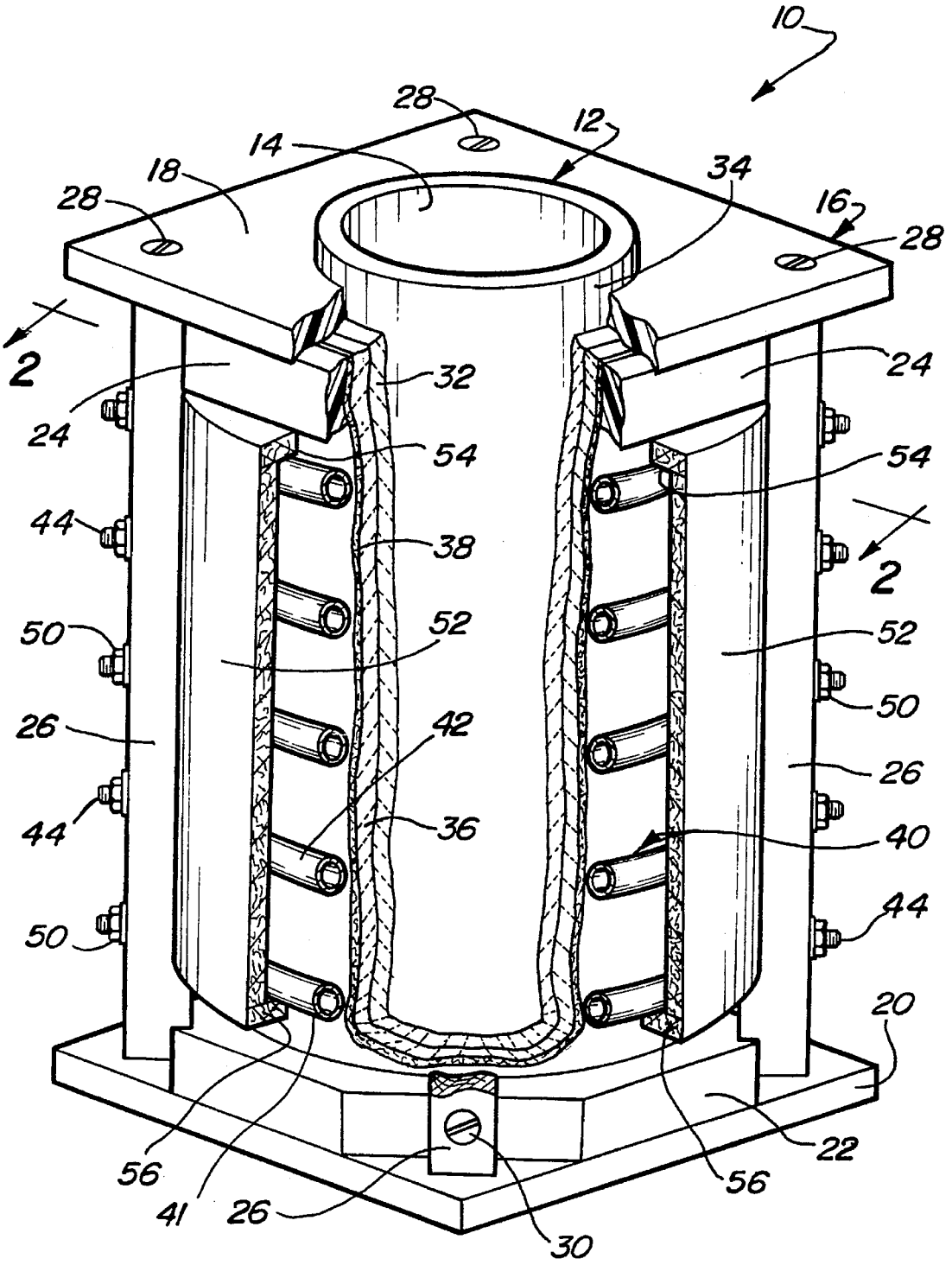
FIG. 1 is a perspective view, partially broken away, of a high performance induction melting coil constructed in accordance with the present invention.

With particular attention to FIGS. 1 and 2, a high performance induction melting apparatus 10 will now be described. Induction melting apparatus 10 includes an elongated crucible 12 having a central bore 14 within which a predetermined quantity of the conductive material or "workpiece" to be melted is disposed. Crucible 12 is rigidly supported and retained within a support assembly 16 that is shown to include upper and lower end plates 18 and 20, respectively, a lower mounting plate 22, upper cross rails 24 and a plurality of vertically extending stud boards 26. The opposite terminal ends of stud boards 26 extend between, and are rigidly affixed to, upper and lower end plates 18 and 20, respectively, via fasteners 28. In addition, upper and lower lateral wall portions of stud boards 26 are rigidly affixed to lower mounting plate 22 and upper cross rails 24 via suitable fasteners 30.

As is known in the art, stud boards 26, are preferably made of wood or a phenolic composition for providing the requisite rigidity while exhibiting relatively low thermal conductivity. Similarly, end plates 18 and 20, mounting plate 22 and cross rails 24 are likewise preferably made of a suitable material, such as wood or a phenolic material, for providing desired structural rigidity and thermal insulative properties.

Encapsulating a substantial portion of crucible 12 is one or more layers of an insulating refractory material In the embodiment shown, the insulating refractory material includes a first refractory layer 32 having a substantially uniform thickness and which encapsulates substantially the entire outer wall surface 34 of truckle 12. In addition, a second layer 36 fabricated of a suitable refractory material or refractory cement is shown to substantially encapsulate first refractory layer 32. Finally, a relatively thin outer layer 38 of an insulative non-metallic fiber-fax material encircles second layer 36. As will be appreciated, the embodiment shown in FIG. 1 is merely exemplary of the type of suitable refractory materials that can be utilized with induction melting apparatus 10. Means for inductively heating the workpiece to be melted within crucible 12 is shown to include a multi-turn induction melting coil 40 fabricated of a continuous length of copper tubing 42. Preferably, a dialetric nylon or epoxy coating insulates the entire outer peripheral surface of copper tubing 42. A power source 41 is electrically interconnected to multi-turn coil 40 for causing an alternating current to flow therethrough for developing a highly concentrated magnetic field in a conventional manner.

For rigidly maintaining the desired spacing between adjacent turns of copper tubing 42, studs 44 are secured to tubing 42 (i.e. brazed) so as to extend radially outwardly from melting coil 40. Studs 44 are generally vertically aligned to define a plurality of sets thereof with the location of each set generally corresponding to the position of stud boards 26. More specifically, studs 44 are aligned with and extend through bores 46 formed in stud boards 26. Fasteners, such as threaded nuts 50, are used for securely fastening stud boards 26 to studs 44 and, in turn, copper tubing 42. In this manner, the turns of melting coil 40 are rigidly maintained in a desired spatial relationship relative to each other and with respect to crucible 12 within support assembly 16.

In accordance with the present invention, relatively thick, flux concentrator inserts 52 fabricated from a low reluctance, high density composition are disposed intermediate copper tubing 42 of induction melting coil 40 and stud boards 26. More particularly, a plurality of flux concentrator inserts 52 are configured so as to substantially encapsulate induction melting coil 40 and provide a low reluctance path within which the lines of magnetic flux travel during induction melting operations. Furthermore, flux concentrator inserts 52 are designed to concentrate the "flux" field or "magnetic" field with respect to the workpiece within crucible 12. Inserts 52 are shown to include upper and lower radially inwardly directed flanges 54 and 56, respectively, that are adapted to engage an outer surface of third insulative layer 38 for substantially encapsulating induction melting coil 40 therein. Also, an inner surface 57 of inserts 52 is oriented to continuously engage the outer most peripheral portion of coil tubing 42. As such, inserts 52 are operable to substantially confine the lines of magnetic flux developed around the turns of copper tubing 42 for inhibiting inductive coupling with surrounding metals (i.e. such as when induction melting coil 40 is placed within a vacuum chamber). In this manner, flux concentrator inserts 52 arc capable of inhibiting inductive heating of any surrounding conductive frame components or interfering with operation of auxiliary electrical control systems.

Figure 2:
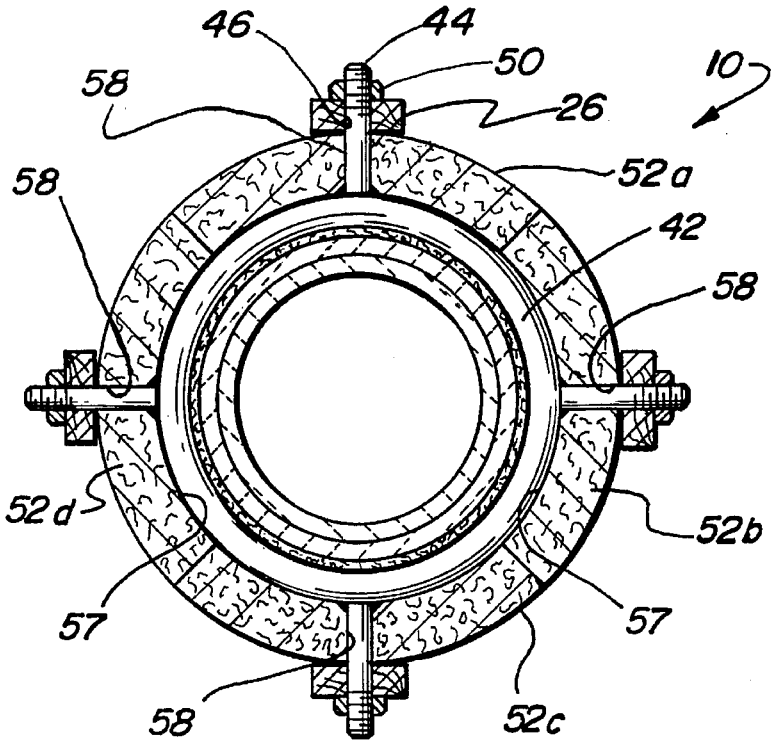
FIG. 2 is a top cross-sectional view taken along line 2—2 of FIG. 1.

With particular reference now to FIG. 2, a top cross-sectional view of induction melting apparatus 10 is shown. As can be seen, flux concentrator inserts 52 define a series of four substantially identical elongated and generally arcuate insert members 52*a* through 52*d*. Moreover, adjacent insert members are sized and configured to abuttingly engage each other along their complimentary mating edge wall surfaces for defining a substantially continuous cylindrical insert 52. Preferably, studs 44 extend generally perpendicular to the turns of copper tubing 42 so as to extend through bores 58 formed in each of the insert members. As will be appreciated, bores 58 arc located to be spatially aligned vertically and circumferentially with bores 46 formed in stud boards 26. As shown, threaded nuts 50 are tightened on studs 44 to act on stud boards 26 for rigidly supporting inserts 52*a* and 52*d* within support assembly 16.

Figure 3:
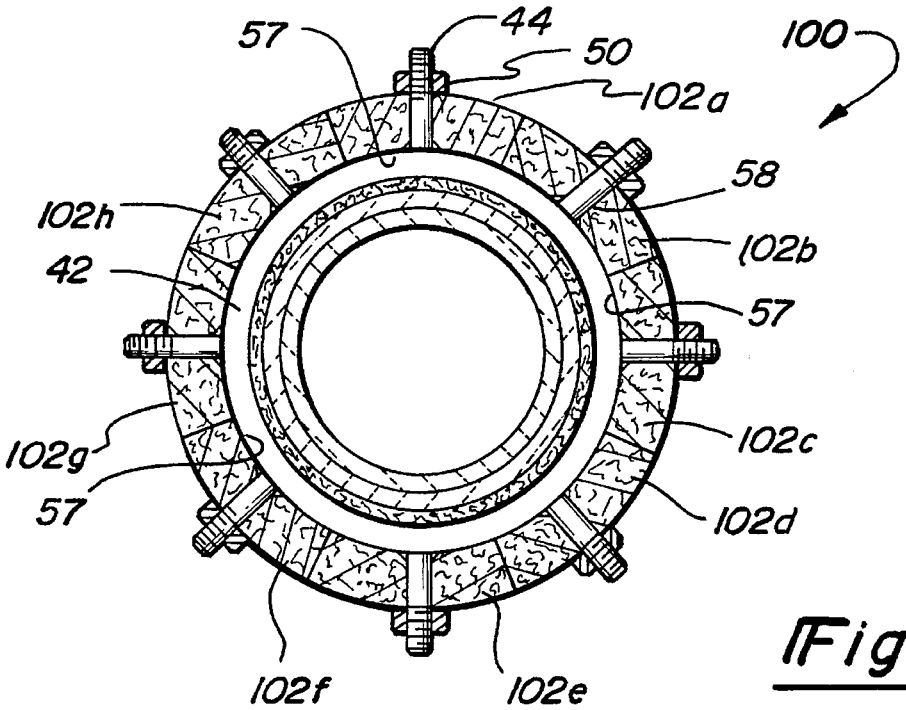
FIG. 3 is a top sectional view, similar to FIG. 2, illustrating an alternative embodiment of a high performance induction melting coil.

With particular reference now to FIG. 3 an alternative embodiment of the present invention is disclosed. More particularly, induction melting apparatus 100 is substantially identical to induction melting apparatus 10 shown in FIGS. 1 and 2. Accordingly, like reference numbers are used to designate previously disclosed components. In general, induction melting apparatus 100 is a modified version of melting apparatus 10 in that stud boards 26 have been eliminated whereby flux concentrator inserts 102*a*–102*h* are configured to be secured directly to upper and lower end plates 18 and 20, respectively, for providing the requisite overall rigidity. Induction melting apparatus 100 is shown to include eight (8) flux concentration inserts 102*a* and 102*h*, that are configured to encapsulate coil tubing 42 in a manner substantially identical to that described herebefore. As is apparent from comparison of FIGS. 2 and 3, flux concentrator inserts 52*a*–52*d* and 102*a*–102*h* can be fabricated and configured in virtually any practical plurality of adjacent members as dictated by the requirements of the particular induction coil application.

The flux concentrator inserts 52*a*–52*d* and 102*a*–102*h* of the present invention are relatively thick non-laminated homogeneous members that are preferably fabricated from a composition generally comprising a ferromagnetic material and a binder. The ferromagnetic material is of a specific class and character and possesses select, specific physical properties. The binder employed comprises a plastic resin or mixtures of plastic resins. In addition, the final composition may optionally include other components such as an acid phosphate and/or a mold release lubricant and a high temperature resistant plastic coating.

A preferred composition employed for fabricating inserts 52*a*–52*d* and 102*a*–102*h* for use in melting apparatus 10 and 100, respectively, of the present invention is disclosed in U.S. Pat. No. 4,776,980, issued Oct. 11, 1988, assigned to the common assignee of the present invention and which is hereby expressly incorporated by reference herein. More specifically, the ferromagnetic material used in the composition is a high purity annealed iron power prepared by electrolytic deposition. The preferred materials have a total carbon content of less than about 0.01 percent and a hydrogen loss of less than about 0.30 percent. In the preferred embodiment, the loose iron powder employed in the compositions of the present invention has an apparent density of greater than about 5.00 grams per cubic centimeter. Preferred materials possess particle sizes wherein a majority of the particles are in the range of about 100 mesh, with less than about 3 percent having a particle size (Tyler) of greater than 100 mesh (i.e. greater than 149 μm and less than about 5 μm). Such materials preferably have an average particle size in the range of about 10 to about 70 μm, and most preferably of about 20 μm.

Another important property of the iron powder employed in the flux concentrator inserts 52*a*–52*d* and 102*a*–102*h* is its particular shape. High purity annealed electrolytically-produced iron powders described above can be characterized as being a predominately non-spherical, disc-shaped material. While not bound by theory it has now been recognized that this shape produces at least two important advantages. First, the shape allows the use of much higher ratios of ferromagnetic material to binder material than other iron materials such as carbonyl iron powders. Secondly, the shape, in combination with the high purity of the class of iron powders employed allows the pressing of inserts 52*a*–52*d* and 102*a*–102*h* at extremely high levels of pressure, e.g. in the range of from about 20 to 60 Tsi (tons per square inch). Accordingly, the selective combination of the purity and shape of this iron powder allows pressing at these high pressures without significant deterioration of performance of the ferromagnetic material. The iron is preferably employed in the composition at a level of from about 80 to about 99.5 percent by weight. The iron is most preferably from about 95 percent to about 99.5 percent.

The ferromagnetic material is incorporated into the compositions in combination with a polymer binder which comprises a polymeric resin or mixture of resins. Typical of the preferred resins are resins of the nylon, fluorocarbons, epoxy and hot melt adhesive types or classes. These are generally characterized by their ability to provide excellent particle-to-particle insulation after pressing. The fluorocarbon binders have been found to be advantageous in the compositions used in forming inserts 52*a*–52*d* and 102*a*–102*h* due to the relative inertness of the composition employing these binders. The fluorocarbon binders, when employed in the composition, also provide a higher temperature resistance and better insulating properties in the final product. The binder is preferably employed at a level of about 0.5 to about 20 percent, and more preferably about 0.5 to about 5 percent by weight of the final product. In a highly preferred embodiment, the binder is present at a level of about one-half to about one percent by weight of the final product. A particularly preferred binder is a fluorinated ethylene propylene material sold by LNP Corporation of Malvern, Pa. as the TL 120 series. Methods of preparation for the composition are also disclosed in U.S. Pat. No. 4,776,980.

Other materials may be optionally employed in the compositions. For example, an insulating material may be employed. In general, the insulating material may include those conventionally employed in the art. Preferred materials include acid phosphates, phosphoric acid ($H_3PO_4$) is particularly preferred as an insulating material and is present in an amount of about 0.1 to about 1 percent based on the composition.

Another preferred optional material is a mold release agent or lubricant. In general, these may be selected from those materials conventionally employed in the art. Preferred mold release agents to be employed in the compositions include metallic salts or fatty acids. Zinc stearate is a particularly preferred mold release agent for use in the composition.

As noted, the composition is pressed and cured into a homogeneous block shape or into the substantially finished shape of the desired flux concentrator insert. If pressed into a block shape, the homogeneous material may be readily machined into any desired shape to conform to the outer most peripheral portion of inductor coil 42 by using common or conventional tools such as a grinding wheel, sand paper, and the like. The blocks may be machined or pressed into any geometric shape and size. For example, inserts 52*a*–52*d* and 102*a*–102*h* may be formed square, rectangular, toroidal, circular, or any other shape required to concentrate the "flux field" or "magnetic field" to the appropriate situs on the workpiece within crucible 12.

Accordingly, the present invention is directed to an improved induction melting apparatus incorporating flux concentrator inserts encapsulating working coil 42 for providing a low reluctance path within which the magnetic field travels during induction melting operations. As such, the present invention results in a high performance induction melting coil configuration providing superior heating efficiency characteristics over conventionally known shunted and non-shunted induction melting coils.

Another feature of the present invention involves the relative ease in which flux concentrator inserts 52*a*–52*d* and 102*a*–102*h* can be replaced and/or retro-fitted onto conventional induction melting coils. Installation of flux concentrator inserts 52*a*–52*d* and 102*a*–102*h* is easily accomplished upon removable of threaded nut 50 from studs 44.

Figure 4:
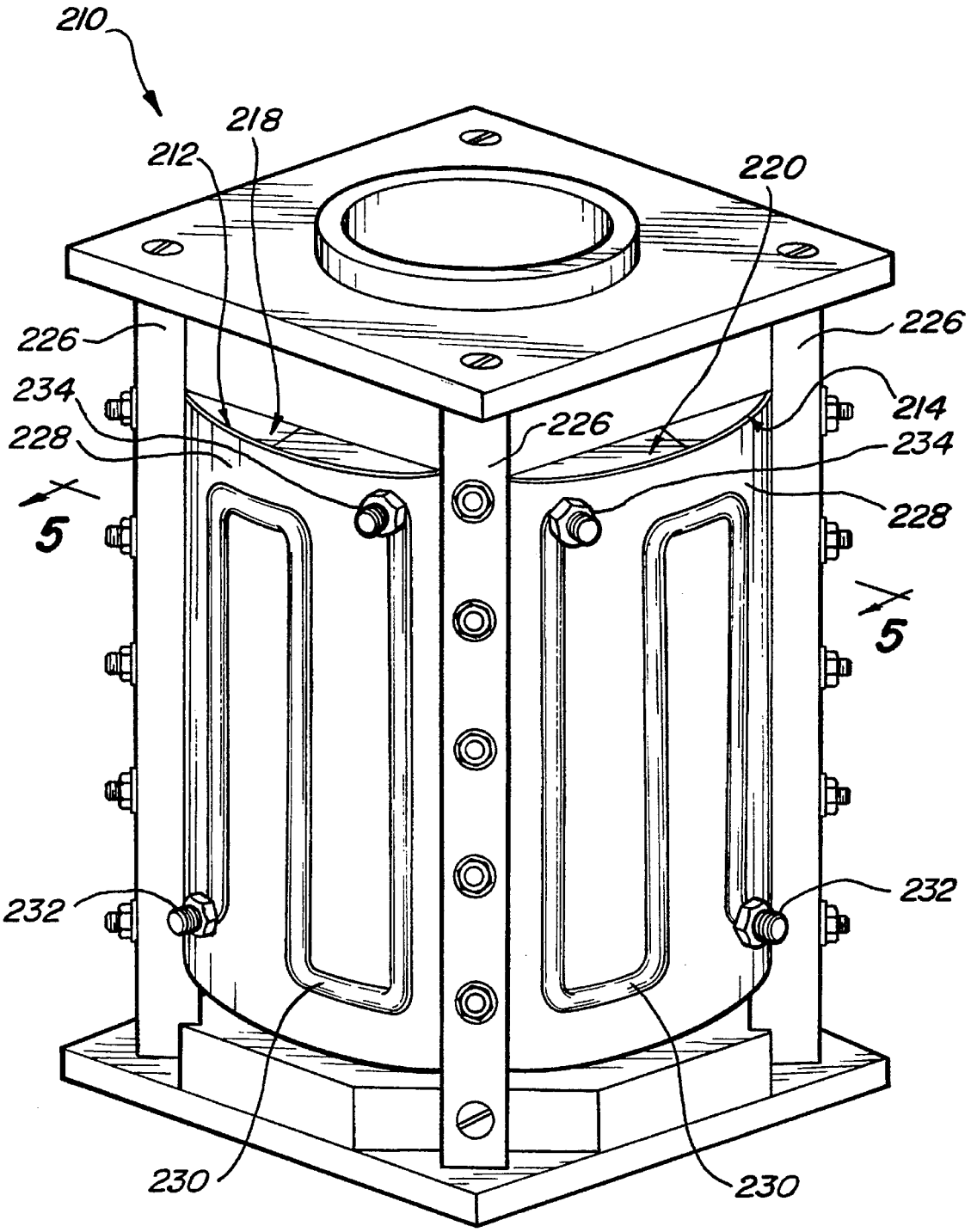
FIG. 4 is an elevational view showing cooling plates utilized with a preferred alternate embodiment of the present invention.
Figure 5:
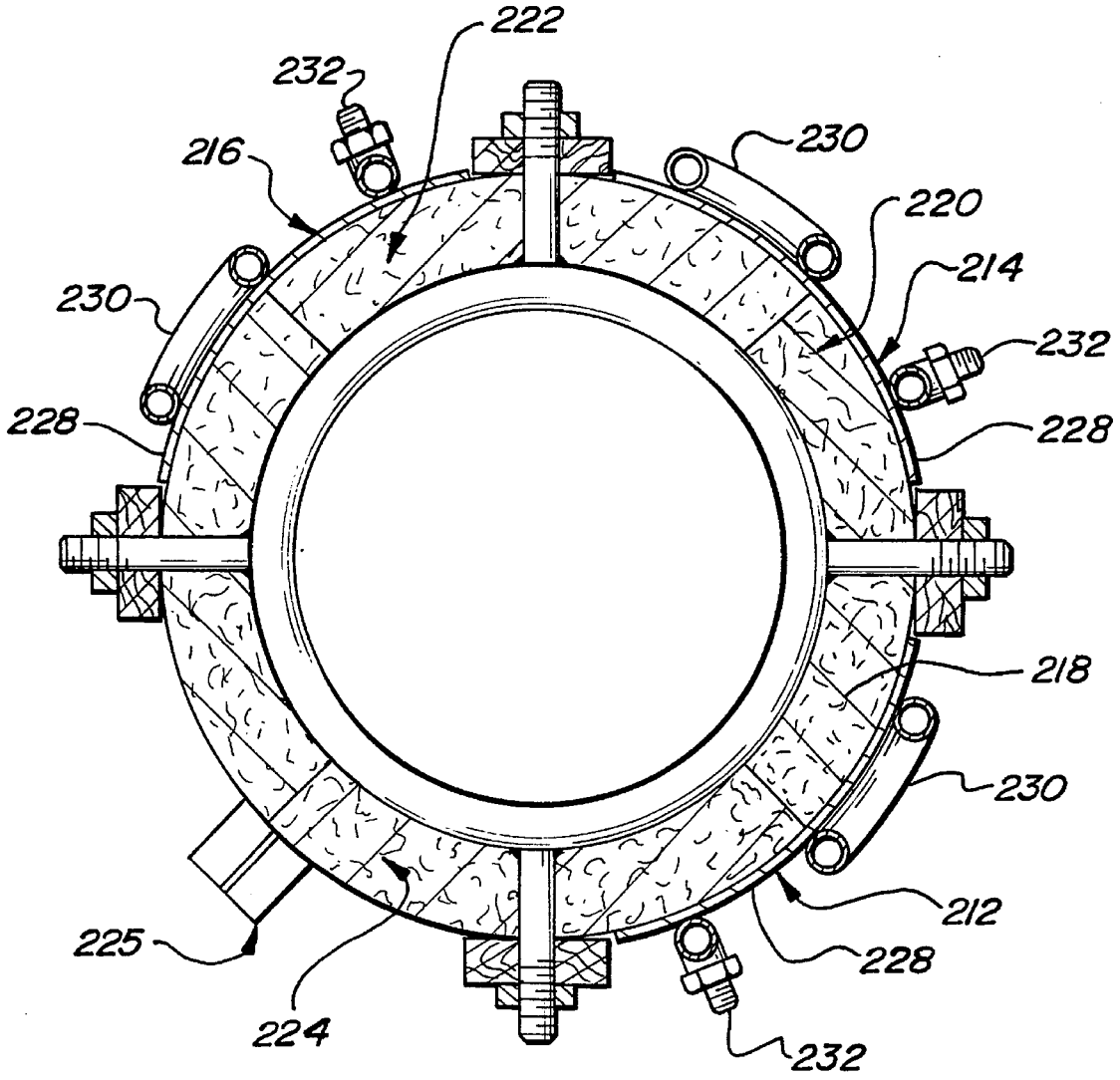
FIG. 5 is a sectional view taken along line 5—5 of FIG. 4.

Referring now to FIGS. 4 and 5, there is shown a preferred alternate embodiment of an induction melting apparatus 210 of the present invention. Induction melting coil 210 is exactly the same as apparatus 10 set forth above with the exception that cooling plates 212, 214 and 216 are affixed to exposed flux concentrator insert areas 218, 220 and 222 between studs 226 for modulating temperature of the flux concentrator insert material. Insert area 224 is left free from a cooling plate to allow for electrical and cooling connections (illustrated at 225) to be connected with the apparatus 210.

The cooling plates 212, 214 and 216 each include an arcuate heat exchange panel portion 228 and a sinuous coolant tube 230 portion. The heat exchange panel portion 228 is preferably a copper plate which is formed to match the outer surface of the flux concentrator inserts 218, 220 and 222. The panel portion 228 is preferably attached directly to the inserts 218, 220 and 222 with epoxy or the like.

The sinuous coolant tubes 230 are preferably generally "S" shaped and are copper tubes brazeally attached to the panel portion 228. Coolant tubes 230 include an inlet end 232 and an outlet end 234. Inlet end 232 and outlet end 234 have suitable threaded connections as shown. Alternatively, quick connect couplings could be utilized for the couplings to an external coolant source.

In operation, suitable coolant may be routed through the inlet end 232 and out through the outlet end 234. This results in cooling of the panel portion 228 which acts to cool the insert areas 218, 220 and 222. Thus, the temperature of the inserts 218, 220 and 222 can be controlled for maximum efficiency of the coil 210 by adjusting coolant flow and temperature of coolant routed through the tubes 230.

While the present invention has been shown and described with respect to various alternative embodiments, it is to be understood that the present invention is not limited thereto, but is susceptible to numerous changes and modifications within the fair scope of the appended claims.

What is claimed is:

1. An induction heating apparatus operable for melting a workpiece, comprising:

a hollow crucible;

an induction melting coil wound to concentrically surrounding said crucible;

power source means operable for establishing an electromagnetic field within said induction melting coil, said electromagnetic field operable for inductively heating said workpiece disposed within said crucible;

support means for maintaining a predetermined spatial relationship between adjacent winding of said induction melting coil; and insert means for substantially encapsulating said induction melting coil, said insert means made from a homogeneous material comprising powdered ferromagnetic material dispersed in a binder whose composition acts to concentrate said electromagnetic field with respect to said workpiece, said insert means generating a low reluctance path within which said electromagnetic field travels while concomitantly confining said electromagnetic field to inhibit inductive heating of auxiliary conductive materials located in close proximity to said induction melting coil.

2. The induction heating apparatus of claim 1 wherein said insert means is a relatively thick and rigid insert member configured to substantially encapsulate said induction melting coil, said insert member having locating means coactive with said support means for retaining said insert member in a predetermined relationship with respect to said induction melting coil.

3. The induction heating apparatus of claim 2 wherein said melting coil is made of copper tubing and said support means includes a plurality of studs fixedly secured to extend radially outwardly from adjacent turns of said copper tubing.

4. The induction heating apparatus of claim 3 wherein said locating means includes a series of bores formed in said insert member that are spatially arranged to permit said studs to extend therethrough, and wherein fastener means are provided for releasably securing said insert member to said studs.

5. The induction heating apparatus of claim 4 wherein said support means further includes stud boards located intermediate said insert member and said fastener means for providing additional rigidity.

6. The induction heating apparatus of claim 1 wherein said insert means is fabricated from a composition comprising about 80 percent to about 99.5 percent by weight of a high purity, annealed electrolytically prepared iron power, and about 0.5 percent to about 20 percent of an insulating polymer binder, wherein said iron powder has a specific surface area of less than about 0.25 $m_2/g$ and a carbon content of less than about 0.01 percent, and wherein said composition after pressing at a pressure of from at least about 20 to about 60 Tsi demonstrates a maximum of 60 percent regression in permeability and a total core loss of less than about 0.8 to about 1.2 ohms between 10 KHz and 500 KHz.

7. The induction heating apparatus of claim 6 wherein the polymer binder is selected from the group consisting of fluorocarbons, epoxies, hot melt adhesives, and mixtures thereof.

8. The induction heating apparatus of claim 6 wherein the polymer binder is an epoxy.

9. The induction heating apparatus of claim 6 wherein the polymer binder is a hot melt adhesive.

10. The induction heating apparatus of claim 6 wherein the polymer binder is a fluorocarbon.

11. The induction heating apparatus of claim 10 wherein the polymer binder is a fluorinated ethylene propylene.

12. The induction heating apparatus of claim 6 wherein the binder is a nylon.

13. The induction heating apparatus of claim 7 which additionally comprises about 0.1 to about 1 percent acid phosphate.

14. The induction heating apparatus of claim 1 wherein said powdered ferromagnetic material is an iron powder which is substantially disc-shaped.

15. The induction heating apparatus of claim 1 wherein said powdered ferromagnetic material is a pressed iron powder which has a hydrogen loss of less than about 0.03 percent prior to addition to the composition.

16. The induction heating apparatus of claim 1 wherein said powdered ferromagnetic material is an iron powder that has an average particle size in the range of about 40 to about 150 μm.

17. The induction heating apparatus of claim 1 further comprising a means for providing cooling to said insert means.

18. The induction heating apparatus of claim 17 wherein said means for providing cooling further comprises a cooling plate means attached to an exterior portion of said insert means.

19. The induction heating apparatus of claim 18 wherein said cooling plate means further comprises a metal plate portion attached directly to said insert means and a coolant tube portion attached to said metal plate whereby a coolant fluid is circulated through said coolant tube portion thereby cooling the plate portion and the insert means.

* * * * *

UNITED STATES PATENT AND TRADEMARK OFFICE

CERTIFICATE OF CORRECTION

PATENT NO. : 5,588,019

DATED : December 24, 1996

INVENTOR(S) : Robert S. Ruffini, et al.

It is certified that error appears in the above-indentified patent and that said Letters Patent is hereby corrected as shown below:

TITLE PAGE, [56] References Cited, U.S. Patent Documents, add --3,403,241 9/1968 H. Kauffman--.

TITLE PAGE, [56] References Cited, Other Publications, "from" should be --Iron--.

Column 1, Line 12, "with-blocks" should be --with blocks--.

Column 2, Line 59-60, "conventional," should be --conventional--.

Column 3, Line 1, "dim-shaped" should be --disc-shaped--.

Column 3, Line 20, "invention." should be --invention;--.

Column 4, Line 3, "26," should be --26--.

Column 4, Line 12, "material" should be --material.--.

Column 4, Line 16, "truckle" should be --crucible--.

Column 5, Line 17, "arc" should be --are--.

Column 5, Line 60, "power" should be --powder--.

UNITED STATES PATENT AND TRADEMARK OFFICE

CERTIFICATE OF CORRECTION

PATENT NO. : 5,588,019

DATED : December 24, 1996

INVENTOR(S) : Robert S. Ruffini, et al.

It is certified that error appears in the above-indentified patent and that said Letters Patent is hereby corrected as shown below:

Column 7, Line 46, "brazeally" should be --brazedly--.

Column 8, Line 46, Claim 6, "power" should be --powder--.

Signed and Sealed this

Seventeenth Day of June, 1997

Bruce Lehman

*Attest:*

BRUCE LEHMAN

*Attesting Officer*

*Commissioner of Patents and Trademarks*